US008480147B2

(12) United States Patent
Jones

(10) Patent No.: US 8,480,147 B2
(45) Date of Patent: Jul. 9, 2013

(54) HAND OPERATED REACHING DEVICE FOR ACCESSING ELEVATED DOORS

(76) Inventor: David J. Jones, Plano, TX (US)

( * ) Notice: Subject to any disclaimer, the term of this patent is extended or adjusted under 35 U.S.C. 154(b) by 0 days.

(21) Appl. No.: 13/173,916

(22) Filed: Jun. 30, 2011

(65) Prior Publication Data

US 2013/0001969 A1 Jan. 3, 2013

(51) Int. Cl.
*B66F 19/00* (2006.01)

(52) U.S. Cl.
USPC ..... 294/175; 16/446

(58) Field of Classification Search
USPC ..... 294/175; 52/19; 182/79; 16/422, 16/424, 427, 444, 445, 446, 402
See application file for complete search history.

(56) References Cited

U.S. PATENT DOCUMENTS 306,188 A * 10/1884 Strong ..... 49/461
406,995 A * 7/1889 Crafts ..... 16/444
888,079 A * 5/1908 Furman ..... 16/445
1,815,923 A * 7/1931 Lawlor ..... 294/175
1,885,186 A * 11/1932 Defoy ..... 292/175
2,063,583 A * 12/1936 Christy ..... 49/461
2,306,844 A * 12/1942 Schultz ..... 16/402
6,283,519 B1 * 9/2001 Dutton et al. ..... 294/175
6,499,192 B1 * 12/2002 Sawyer ..... 16/442
2011/0225899 A1 * 9/2011 Melesky ..... 52/19

* cited by examiner

*Primary Examiner* — Saul Rodriguez
*Assistant Examiner* — Gabriela Puig
(74) *Attorney, Agent, or Firm* — Stephen J. Walder, Jr.

(57) ABSTRACT

A hand operated reaching device is provided that comprises a rigid rod member, a handle coupled to the rigid rod member, and an attachment head coupled to the rigid rod member. The attachment head comprises an attachment mechanism configured to engage a pull device coupled to a door of an elevated doorway, such as an attic door. When a downward force is applied to the hand operated reaching device while the attachment mechanism is engaged with the pull device, the downward force causes the door to open downward. A system is further provided that comprises the hand operated reaching device, the pull device, and an optional fastener for fastening the pull device to a door of an elevated doorway.

17 Claims, 4 Drawing Sheets

HAND OPERATED REACHING DEVICE FOR ACCESSING ELEVATED DOORS

BACKGROUND

The present application relates generally to an improved hand operated reaching device and more specifically to a hand operated reaching device for accessing elevated doors.

Many homes, buildings, and other dwelling structures make use of elevated doorways and associated ladders. For example, a large majority of homes have elevated doorways for accessing attics of these homes. These doorways are typically provided in a ceiling of a room of the structure, e.g., a house, and have attached foldable ladders on one side that are able to be extended down to the floor of the house once the door of the doorway has been pulled down and locked into a locking position.

Typically, a person is able to access the doorway by way of a pull rope, string, or cord attached to the door of the doorway and which hangs down from the elevated location of the door towards the floor, i.e. from the door that is mounted in the doorway provided in the ceiling of the house downwards to the floor of the house. While these pull ropes, strings, or cords provide a mechanism by which a person call pull the door down to gain access to the doorway, the pull rope, string, or cord must be present and attached to the door at all times, even when not being used to pull the door down to gain access to the doorway. This means that when the pull rope, string, or cord is not being used to access the doorway by pulling down the door, it hangs down from the door in the ceiling towards the floor. This tends to be an eyesore, especially in situations where the doorway is provided in a ceiling that is higher than average ceiling heights, e.g., so-called "cathedral" ceilings or the like, since the length of the pull rope, string, or cord must be significantly longer due to the need to extend the pull rope, string, or cord to a height above the floor that is reachable by an average person. Moreover, in cases where the ceilings are higher than normal or the person trying to access the doorway is shorter than an average height, it may be difficult for the person trying to access the doorway to reach the pull rope, string, or cord in order to be able to pull down the door to gain access to the doorway.

Furthermore, in cases where the pull rope, string, or cord hangs down from the door of an elevated doorway, the pull rope, string, or cord may represent a nuisance to persons passing by the pull rope, string, or cord in that they may run into it while passing. This is especially true for persons that have greater than average height.

SUMMARY

In one illustrative embodiment, a hand operated reaching device is provided that comprises a rigid rod member, a handle coupled to the rigid rod member, and an attachment head coupled to the rigid rod member. The attachment head comprises an attachment mechanism configured to engage a pull device coupled to a door of an elevated doorway. When a downward force is applied to the hand operated reaching device while the attachment mechanism is engaged with the pull device, the downward force causes the door to open downward.

In some illustrative embodiments, the rigid rod member may be fabricated from one of a wood material, a metal material, a plastic material, or a composite material. In some illustrative embodiments, the rigid rod member may have one of a circular cross-section or a rectangular cross-section. In some illustrative embodiments, the rigid rod member may be comprised of a plurality of sections configured in a telescoping manner such that the rigid rod member is extendible from a non-extended length to a fully-extended length.

In one or more illustrative embodiments, the handle may be comprised of one of a foam material, a rubber material, or a plastic material. In one or more illustrative embodiments, the handle comprises recesses for placement of a person's fingers.

In some illustrative embodiments, the attachment head may be coupled to the rigid rod at an end of the rigid rod opposite of the handle. The attachment mechanism may be one of integrally formed with the attachment head or coupled to the attachment head.

In one or more illustrative embodiments, the attachment mechanism is one of a hook, a clasp, a suction device, or the like. In one or more illustrative embodiments, the attachment head comprises a channel, the attachment mechanism may be coupled to the attachment head by way of a movable coupling, and the attachment mechanism may be movable about an axis of the movable coupling from an original position to a position within the channel.

In one or more illustrative embodiments, the attachment mechanism may be coupled to a return device. The return device may operate to return the attachment mechanism to the original position when an external force is not exerted on the attachment mechanism.

In still other illustrative embodiments, a system for installing hardware for operating a hand operated reaching device to access a door of an elevated doorway is provided. The system may comprise a hand operated reaching device and a pull device for installation in the door of the elevated doorway. The pull device may comprise a loop portion, an attachment portion, and a coupling between the loop portion and the attachment portion. The pull device may be coupled to the door by insertion of the attachment portion into a hole in the door. The hand operated reaching device may comprise a rigid rod member, a handle coupled to the rigid rod member, and an attachment head coupled to the rigid rod member. The attachment head may comprise an attachment mechanism configured to engage the loop portion of the pull device. When a downward force is applied to the hand operated reaching device while the attachment mechanism is engaged with the pull device, the downward force causes the door to open downward.

In some illustrative embodiments, the system further comprises a decorative cover piece through which the attachment portion of the pull device may be passed before the attachment portion is inserted into the hole in the door. In some illustrative embodiments, the system further comprises a fastener for fastening the attachment portion of the pull device to the door. In some illustrative embodiments, the pull device may be configured to be flush with a surface of the door.

In one or more illustrative embodiments, the rigid rod member may be fabricated from one of a wood material, a metal material, a plastic material, or a composite material, and the rigid rod member may have one of a circular cross-section or a rectangular cross-section. In one or more illustrative embodiments, the rigid rod member may be comprised of a plurality of sections configured in a telescoping manner such that the rigid rod member is extendible from a non-extended length to a fully-extended length. In some illustrative embodiments, the handle may be comprised of one of a foam material, a rubber material, or a plastic material, and the handle may comprise recesses for placement of a person's fingers.

In one or more illustrative embodiments, the attachment head may be coupled to the rigid rod at an end of the rigid rod opposite of the handle, and the attachment mechanism may be one of integrally formed with the attachment head or coupled to the attachment head. In one or more illustrative embodiments, the attachment mechanism is one of a hook, a clasp, a suction device, or the like.

In some illustrative embodiments, the attachment head may comprise a channel, the attachment mechanism may be coupled to the attachment head by way of a movable coupling, and the attachment mechanism may be movable about an axis of the movable coupling from an original position to a position within the channel. In some illustrative embodiments, the attachment mechanism may be coupled to a return device and the return device may operate to return the attachment mechanism to the original position when an external force is not exerted on the attachment mechanism.

These and other features and advantages of the present invention will be described in, or will become apparent to those of ordinary skill in the art in view of, the following detailed description of the example embodiments of the present invention.

BRIEF DESCRIPTION OF THE SEVERAL VIEWS OF THE DRAWINGS

The invention, as well as a preferred mode of use and further objectives and advantages thereof, will best be understood by reference to the following detailed description of illustrative embodiments when read in conjunction with the accompanying drawings, wherein.

DETAILED DESCRIPTION

The illustrative embodiments provide a hand operated reaching device for use in accessing doors of elevated doorways, such as attic doorways in a house, building, or other structure. The hand operated reaching device permits the removal of the typical hanging rope, string, or cord from doors of elevated doorways thereby eliminating the eyesore and nuisance associated with them while increasing the ease by which access to the elevated doorway is made possible.

Figure 1:
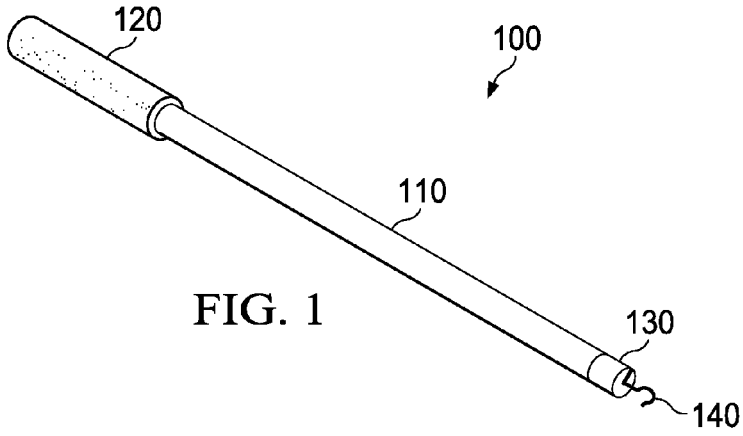
FIG. 1 is an example diagram of a hand operated reaching device having a fixed grasping mechanism in accordance with one illustrative embodiment.

FIG. 1 is an example diagram of a hand operated reaching device having a fixed grasping mechanism in accordance with one illustrative embodiment. As shown in FIG. 1, the hand operated reaching device 100 comprises a rigid rod 110 having a handle 120, and an attachment head 130 having a grasping mechanism 140. The rigid rod 110 may be fabricated from any suitable material that will provide sufficient strength and rigidity to accommodate the forces associated with pulling down the weight of a door of an elevated doorway. Examples of some suitable materials include, but are not limited to, wood, metal, heavy plastics, composite materials, and the like. The rigid rod 110 may be fabricated from one or more solid pieces of material, may be fabricated from one or more hollow pieces of material, or a combination of pieces that are solid and hollow. In one illustrative embodiment, the rigid rod 110 is a solid cylinder of wood material, where the wood material may be any type of wood material of suitable rigidity and strength.

The rigid rod 110 may have many different cross-sections. In one illustrative embodiment, the cross-section of the rigid rod 110 is circular such that the rigid rod 110 is a hollow or solid cylinder. In other illustrative embodiments, the rigid rod 110 may have other cross-sections including a rectangular cross section, oval cross section, triangular cross section, or the like.

In one illustrative embodiment the rigid rod 110 has a fixed length. In other illustrative embodiments, the rigid rod 110 may be fabricated as a telescoping rod making the rigid rod 110 variable in length from a non-extended length to a fully-extended length. As such, the rigid rod 110 may be comprises of a plurality of smaller hollow rigid rods, one inside another, that may slide within each other so that they may be collapsed to a non-extended length or extended to a fully-extended length.

At one end of the rigid rod 110 is a handle 120 suitable for grasping by a person's hand or hands. Although not shown in FIG. 1, a second handle may be provided at a different location along the rigid rod 110 so as to provide a second grasping point for another of the person's hands in order to provide extra leverage when exerting a force on the hand operated reaching device 100.

The handle 120 may be made from any suitable material including the same material used to fabricate the rigid rod 110. In some illustrative embodiments, the handle 120 is fabricated from a foam material, a rubber material, a plastic material, or the like. The material chosen for fabricating the handle 120 preferably has a flexibility of cushion feel so as to enhance the comfort of a person holding the hand operated reaching device 100 via the handle 120. The handle 120 may have ridges and recesses to engage the fingers of a person's hand to assist in grasping the hand operated reaching device 100.

The handle 120 is affixed to the rigid rod 110 at one end using any suitable affixing mechanism. Examples of affixing mechanisms include, but are not limited to, glue, staples, hardware mechanisms including screws, nails, nuts and bolts, clasps, or the like. The affixing mechanism is of an amount and type to permit strength of the attachment between the handle 120 and the rigid rod 110 to support forces on the attachment between the handle 120 and the rigid rod 110 due to pulling on the hand operated reaching device 100 by a person grasping the handle 120 and forces resisting the pulling forces exerted by the weight and inertia of a door of an elevated doorway to which the hand operated reaching device 100 is attached when in use.

At an opposite end of the rigid rod 110 from the handle 120, an attachment head 130 is affixed to the rigid rod 110. The attachment head 130 may be affixed to the rigid rod 110 using any suitable affixing mechanism. Examples of affixing mechanisms include, but are not limited to, glue, staples, hardware mechanisms including screws, nails, nuts and bolts, clasps, or the like. The affixing mechanism is of an amount and type to permit strength of the attachment between the attachment head 130 and the rigid rod 110 to support forces on the attachment between the attachment head 130 and the rigid rod 110 due to pulling on the hand operated reaching device 100 by a person grasping the handle 120 and forces resisting the pulling forces exerted by the weight and inertia of a door of an elevated doorway to which the hand operated reaching device 100 is attached when in use.

The attachment head 130 may be fabricated from any suitable material having sufficient strength to accommodate the forces associated with pulling a door of an elevated doorway down so that a person may access the elevated doorway. Examples of suitable materials include wood, metals, plastics, composite materials, or the like. The material used to fabricate the attachment head 130 may be the same material as used to fabricate the rigid rod 110 or may be a different material. In one illustrative embodiment, the attachment head 130 is fabricated from a metal material, the rigid rod 110 is fabricated from a wood material, and the handle 120 is fabricated from a rubber material.

The attachment head 130 has an attachment mechanism 140 for attaching the hand operated reaching device 100 to a pull device attached to a door of an elevated doorway. In one illustrative embodiment, the attachment mechanism 140 is a hook which can hook onto the pull device so that a person can exert a force through a pulling motion downward. In so doing, the force downward causes a force to be applied to the pulling device which in turn causes the door to be pulled downward. The door is hinged in the elevated doorway and thus, the door is pulled clown at one end opposite the hinges until it reaches a locked position at which point the ladder attached to one side of the door may be unfolded and extended.

The attachment mechanism 140 may take many forms other than a hook including a clasp, a suction device, or the like. The attachment mechanism 140 may be integrated with the attachment head 130 or may be a separate piece from the attachment head 130 but affixed to the attachment head 130 using a suitable affixing means. For example, as a separate piece, the attachment mechanism 140 may be a metal hook with a screw at one end to allow the metal hook to be screwed into the attachment head 130 and/or one end of the rigid rod 110. In another example, the metal hook may be formed as an integral part of the attachment head 130. Other configurations are likewise possible without departing from the spirit and scope of the illustrative embodiments.

Figure 2A:
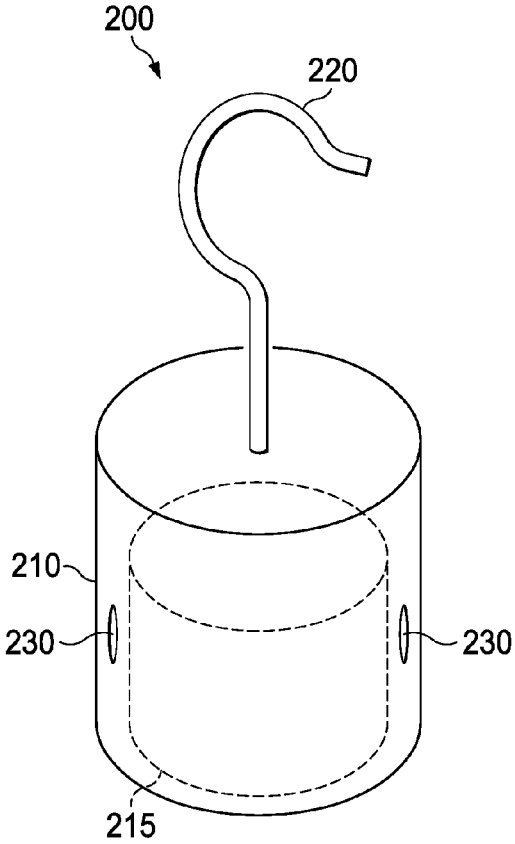
FIG. 2A is an example diagram of an attachment head of a hand operated reaching device in accordance with one illustrative embodiment.

FIG. 2A is an example diagram of an attachment head of a hand operated reaching device in accordance with one illustrative embodiment. As shown in FIG. 2A, the attachment head 200 has a base portion 210 and the attachment mechanism 220 which again may be a separate piece attached to the base portion 210 or may be formed integrally with the base portion 210. The base portion 210 may be hollow in at least a part 215 of the base portion 210 to allow the base portion 210 to be slipped over the end of the rigid rod 110. Glue, cement, or another type of affixing means may be provided on the inside surface of the hollow part 215 of the base portion 210 to thereby affix the attachment head 200 to the rigid rod 110.

One or more holes 230 may be provide in the attachment head 200 to allow hardware type affixing means to be used to affix the attachment head 200 to the rigid rod 110. For example, the holes 230 may permit a screw, nail, bolt, or the like, to pass through the hole and engage the material of the rigid rod 110 to thereby hold or affix the attachment head 200 to the rigid rod 110.

Figure 2B:
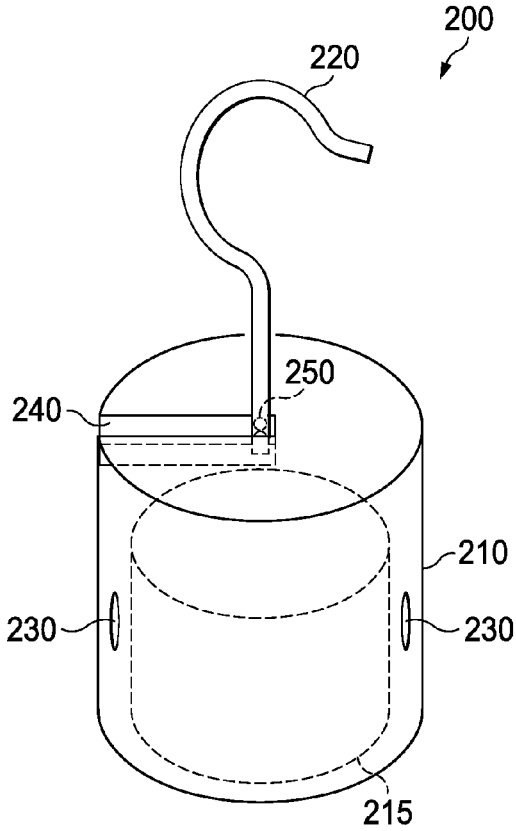
FIG. 2B is an example diagram of an attachment head of a hand operated reaching device in which a channel and movable attachment mechanism are provided in accordance with one illustrative embodiment.

It should be noted that in the example shown in FIG. 2A, the attachment mechanism 220 is attached to the base portion 210, or is integrally formed with the base portion 210, such that the attachment mechanism 220 is fixed in position relative to the base portion 210. In other illustrative embodiments, such as shown in FIG. 2B, a channel 240 may be provided in the base portion 210 and the attachment mechanism 220 may be attached to the base portion 210 by way of a movable coupling 250, such as a hinge, ball joint, or other movable coupling 250. These mechanisms 240 and 250 allow the attachment mechanism 220 to rotate about an axis of the coupling 250 to a maximum position resting in the channel 240.

The rotation of the attachment mechanism 220 allows a person to initially apply a pulling force downward on the hand operated reaching device 100 to initially move the door of the elevated doorway downward and then continue that motion to a greater degree at an angle. This allows the door to be moved downward by a greater amount until the attachment mechanism 220 reaches a maximum position resting in the channel 240. The channel 240 may be provided substantially perpendicular to a central axis of the rigid rod 110, or may be at a greater angle, anywhere between perpendicular and parallel to the central axis of the rigid rod 110, depending on the particular implementation. The channel 240 being at a greater angle provides a large rotation of the attachment mechanism 220 and thus, a greater range of motion by the person applying a downward or angular force to the hand operated reaching device 100.

The attachment mechanism 220 may have a return mechanism (not show) for returning the attachment mechanism 220 to an original position when not forced out of the original position by an applied force. For example, this return mechanism may be a spring or other mechanism that returns the attachment mechanism 220 to its original position when no outside force, such as the applied downward force by the person when the attachment mechanism 220 is engaged with the pull device attached to the door of the elevated doorway.

Figure 3A:
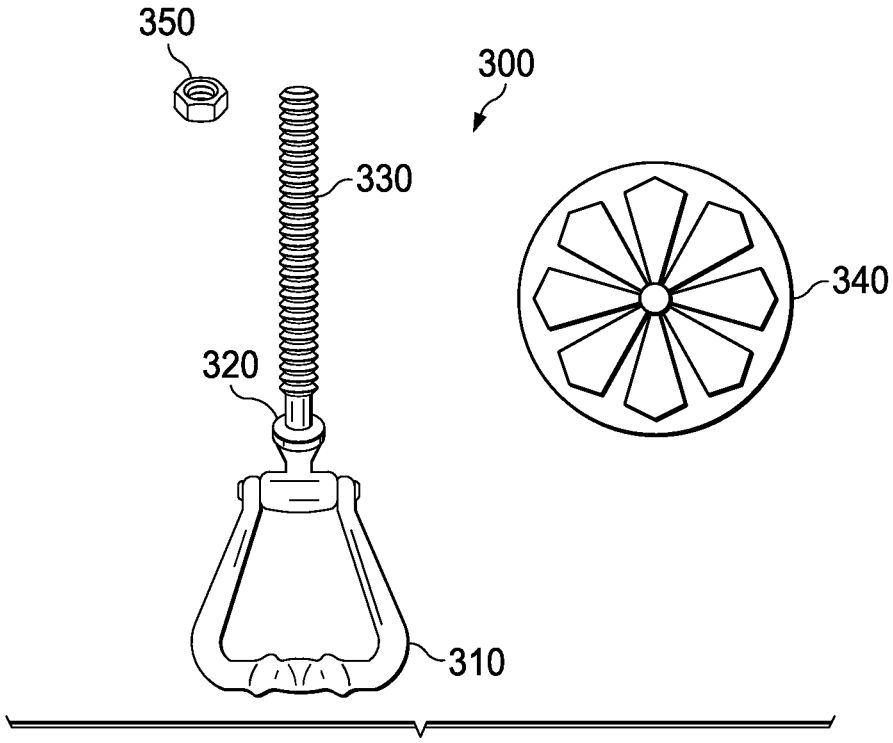
FIG. 3A is an example diagram of a pull device for use with a hand operated reaching device in accordance with one illustrative embodiment.

FIG. 3A is an example diagram of a pull device for use with a hand operated reaching device in accordance with one illustrative embodiment. As shown in FIG. 3, the pull device 300 comprises a loop portion 310, a coupling 320, and an attachment portion 330. The pull device 300 may be fabricated from any suitable material that provides sufficient strength to accommodate the forces of a person pulling on the pull device 300 using the hand operated reaching device 100 and the forces of the weight an inertia of a door of an elevated doorway to which the pull device 300 is attached via the attachment portion 330.

The attachment portion 330 may take many different forms including a screw type portion, a nail type portion, or the like. In one illustrative embodiment, the attachment portion may be a screw. The attachment portion 330 may be used to attach the pull device 300 to a door of an elevated doorway through a whole drilled into the door. For example, when the mechanisms of the illustrative embodiments are used to replace an existing pull cord, string, or rope on an existing door of an elevated doorway, the attachment portion 330 may be used with the existing hole where the pull cord, string, or rope used to be present.

The loop portion 310 provides a surface with which the attachment mechanism 140 of the attachment head 130 of the hand operated reaching device 100 may engage. For example, a hook-type attachment mechanism 140 may engage the loop portion 310 and may remain engaged while a person pulls on the hand operated reaching device 100 to exert a downward force to pull the door downward allowing access to the elevated doorway.

The loop portion 310 may be coupled to the attachment portion 330 by way of a coupling 320. The coupling 320 may be a hinged coupling, ball and socket joint coupling, a fixed coupling that does not allow motion, or the like. Any type of coupling that permits rotation or motion in one or more axes of motion may be used without departing from the spirit and scope of the illustrative embodiments. Alternatively, the coupling 320 may be a portion of the pull device 300 that integrates the loop portion 310 with the attachment portion.

A decorative cover piece 340 may be provided having a hole at the center through which the attachment portion 330 may pass. The cover piece 340 serves to cover the area where the attachment portion 330 attaches the pull device 300 to the door of an elevated doorway. This provides a more aesthetically pleasing look than if the decorative cover piece 340 were not present.

An optional fastener 350 may be provided for assisting in fastening the pull device 300 to the door of the elevated doorway. The fastener 350, in the depicted example, is a nut that is screwed onto the attachment portion 330 which is a threaded screw in this example. Many different types of fasteners 350 can be used depending on the particular implementation of the attachment portion 330 without departing from the spirit and scope of the illustrative embodiments. Moreover, the fastener 350 is optional and thus, many illustrative embodiments may not utilize a fastener 350.

The example pull device 300 shown in FIG. 3A has a significantly smaller visual footprint than the pull rope, string, or cord that is typically used with doors of elevated doorways, e.g., attic doors or the like. However, the loop portion 310 of the pull device 300 may still hang down from the door of the elevated doorway. In other illustrative embodiments, the pull device 300 may take other forms that allow the loop portion 310 to be flush or lie flat against the surface of the door of the elevated doorway.

For example, the loop portion 310 of the pull device 300 may be formed of a metal material that is magnetic and may be magnetically pulled towards the decorative cover 340 or other base plate (not show) that is flush with the door. Alternatively, the loop portion 310 may have a return mechanism, such as a spring or the like, that returns the loop portion 310 to a flush position relative to the door when not having a force exerted on the loop portion 310. In such embodiments, the attachment head 130 may likewise be magnetic such that it may be used to exerted a magnetic pulling force on the loop portion 310 to cause the loop portion 310 to extend downward for engagement by the attachment mechanism 140.

Figure 3B:
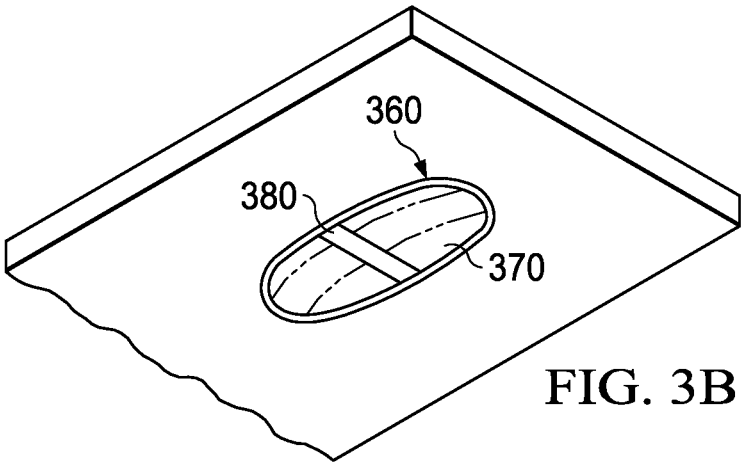
FIG. 3B is an example diagram of another illustrative embodiment of the pull device that is installed in the door of an elevated doorway such that the pull device sits flush with the surface of the door.

FIG. 3B is an example diagram of another illustrative embodiment of the pull device that is installed in the door of an elevated doorway such that the pull device 360 sits flush with the surface of the door. In FIG. 3B, the pull device 360 comprises a concave portion 370 forming a dome or recessed portion into which the attachment mechanism 140 of the attachment head 130 of the hand operated reaching device 100 may be placed. A bar 380 may be provided traversing the gap created by the concave portion 370 so that the attachment mechanism 140 may grasp the bar 380 so that a downward force may be applied to the bar 380 and thus, the door to which the pull device 360 is installed. The pull device 360 in this embodiment sits flush with the door so that there is minimal visual footprint.

Figure 4:
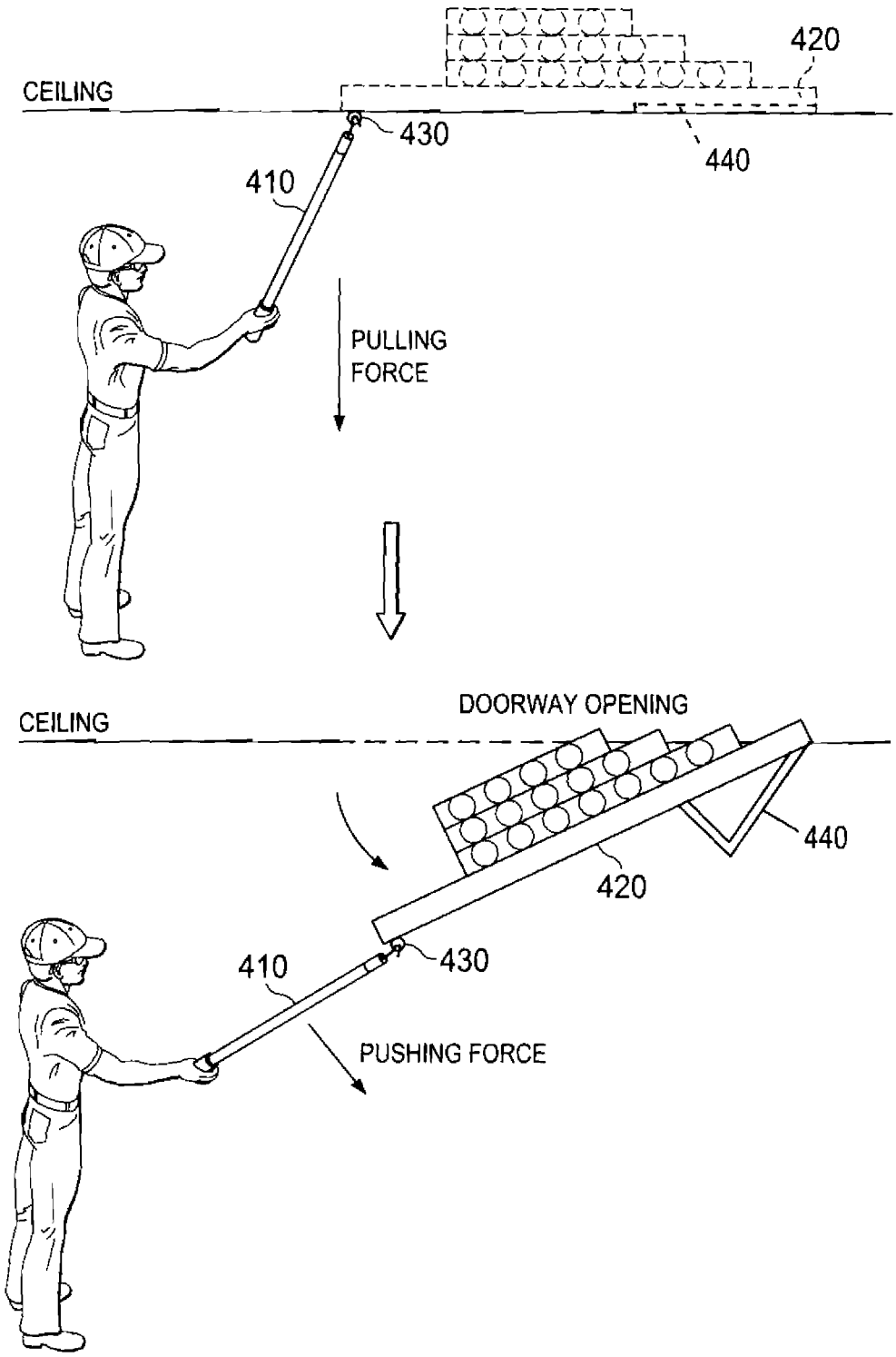
FIG. 4 is an example diagram illustrating a use of the hand operated reaching device with a door of an elevated doorway in accordance with one illustrative embodiment.

FIG. 4 is an example diagram illustrating a use of the hand operated reaching device with a door of an elevated doorway in accordance with one illustrative embodiment. As shown in FIG. 4, when a person wishes to access an elevated doorway, such as an attic doorway or the like, the person may use a hand operated reaching device 410 in accordance with the illustrative embodiments set forth herein. The door 420 may be equipped with a pull device 430 in accordance with one of the illustrative embodiments set forth herein. The attachment mechanism, e.g., a hook, of the hand operated reaching device 410 may attach to the pull device 430 and the person holding the hand operated reaching device 410 may apply a downward force on the hand operated reaching device 410 so as to pull the door 420 down from its elevated position flush with the elevated doorway. As a result, the door 420 rotates about an axis of a hinge 440 coupling the door to the doorway frame. A continued downward force may be applied by the person holding the hand operated reaching device 410 on the hand operated reaching device 410 so as to lower the door 420 to a locked position (illustrated in FIG. 4 by dashed lines).

Figure 5:
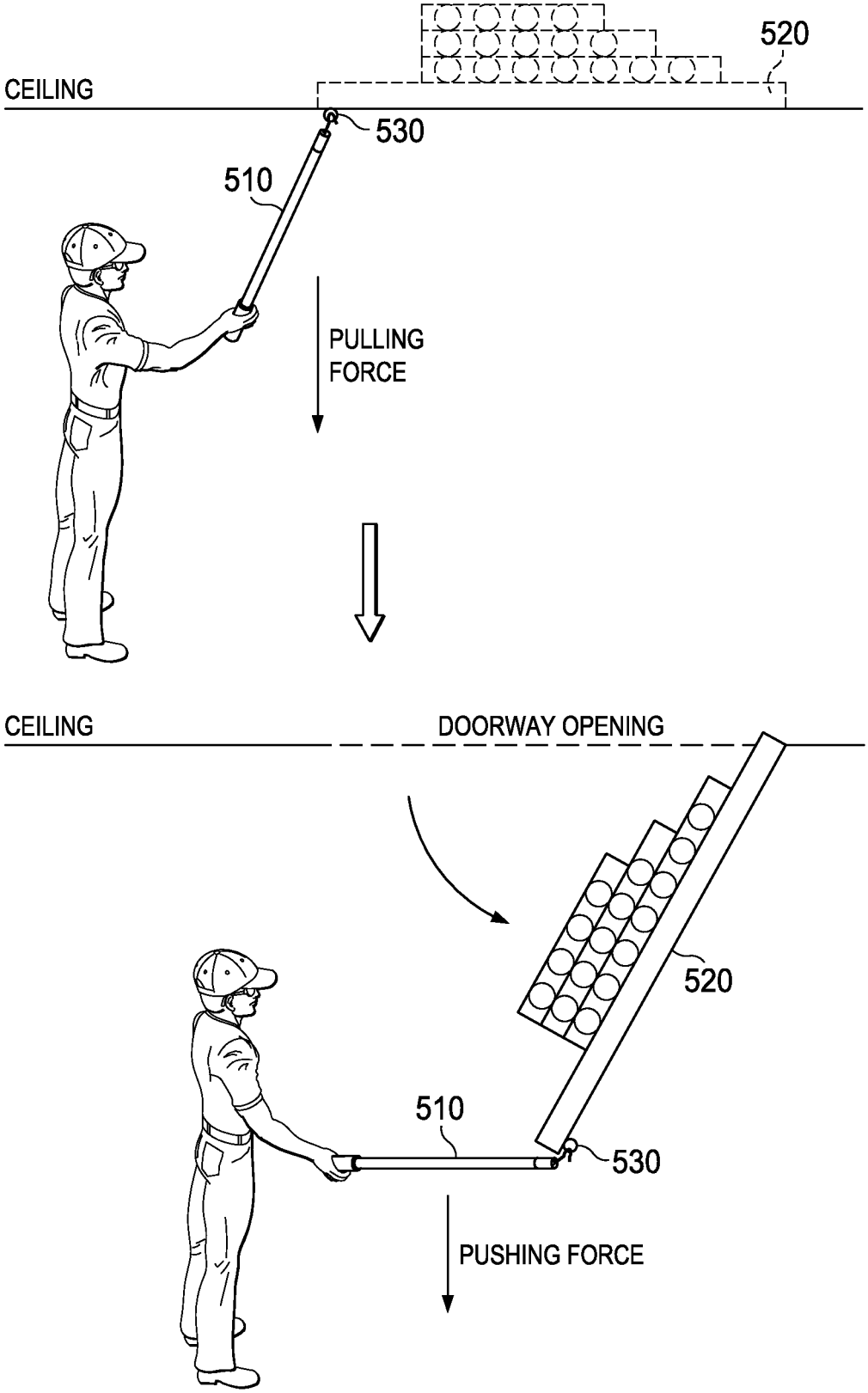
FIG. 5 is an example diagram illustrating a use of the hand operated reaching device having a movable attachment mechanism in accordance with another illustrative embodiment.

FIG. 5 is an example diagram illustrating a use of the hand operated reaching device having a movable attachment mechanism in accordance with another illustrative embodiment. The primary difference between FIG. 5 and FIG. 4 is the angle of the attachment mechanism of the hand operated reaching device 410, and the hand operated reaching device 410 itself, relative to the door 420 due to the movable attachment mechanism. The movable attachment mechanism allows a person to exert a more natural feeling and stronger downward force on the door 420.

In either case, i.e. either the example of FIG. 4 or the example in FIG. 5, the hand operated reaching device 410 allows a person to reach the door 420 even if it is out of range of the person's natural reach ability. This made even more possible when an embodiment using a telescope rigid rod is used. This will allow a person to reach elevated doorways in buildings having ceilings that are higher than the average ceiling, e.g., cathedral ceilings. Moreover, the illustrative embodiments avoid the aesthetically unpleasing and even nuisance of a pull cord, string, or rope. Thus, the illustrative embodiments provide a significant improvement over the standard implementation of elevated doorways.

The hand operated reaching device may be distributed as a kit comprising a plurality of components. The kit may be packaged together for installation on a door of an elevated doorway, such as an attic doorway. The kit may comprise the hand operated reaching device, one or more pull devices, one or more fasteners, and one or more decorative covers. A purchaser of the kit may attach the pull devices to an existing door of an elevated doorway by removing any existing pull cord, rope, or string and attaching the pull devices through the existing hole where the pull cord, rope, or string was present. Alternatively, if necessary, a new hole may be drilled so that the one or more pull devices may be installed. At least one of the pull devices may be passed through a decorative cover and fastened through the hole using at least one of the fasteners. Once the pull device is installed, the hand operated reaching device may be used in conjunction with the pull device in the manner previously described to move the door so that the folding ladder may be extended to gain access to the elevated doorway, e.g., the attic or the like.

Thus, the illustrative embodiments provide mechanisms for eliminating unsightly pull cords, ropes, or strings on doors of elevated doorways. Moreover, the illustrative embodiments provide mechanisms for allowing a person to access elevated doorways that are installed in ceilings that are higher than average ceiling heights.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A system for installing a hardware for operating a hand operated reaching device to access a door of an elevated doorway, comprising:

the hand operated reaching device; and a pull device for installation in the door of the elevated doorway, wherein:

the pull device comprises a loop portion, an attachment portion, and a coupling between the loop portion and the attachment portion, the pull device is coupled to the door by insertion of the attachment portion into a hole in the door, the loop portion of the pull device descends from a surface of the door downward and substantially perpendicular to a plane of the elevated doorway when the door of the elevated doorway is in a closed position, the hand operated reaching device comprises a rigid rod member, a handle coupled to the rigid rod member, and an attachment head coupled to the rigid rod member, the attachment head comprises an attachment mechanism configured to engage the loop portion of the pull device, and the hand operated reaching device provides a structural assembly that applies a first downward force to the door when a second downward force is applied to the hand operated reaching device while the attachment mechanism is engaged with the pull device, the first downward force causes the door to open downward, wherein the elevated doorway is an attic doorway in a ceiling of a room in a building, the door is a door for accessing a next higher level of the building, and the hand operated reaching device causes the door to open downward, from a plane of the elevated doorway towards a plane perpendicular to the plane of the elevated doorway, when the first downward force is applied to the door, in response to the second downward force being applied to the hand operated reaching device, so as to create an opening in the elevated doorway for a person to access the next higher level of the building.

2. The system of claim 1, further comprising:

a decorative cover piece through which the attachment portion of the pull device is passed before the attachment portion is inserted into the hole in the door.

3. The system of claim 1, further comprising:

a fastener for fastening the attachment portion of the pull device to the door.

4. The system of claim 1, wherein the handle is comprised of one of a foam material, a rubber material, or a plastic material.

5. The system of claim 1, wherein the attachment head is coupled to the rigid rod at an end of the rigid rod opposite of the handle, and wherein the attachment mechanism is one of integrally formed with the attachment head or coupled to the attachment head.

6. The system of claim 1, wherein:

the attachment head comprises a channel, the attachment mechanism is coupled to the attachment head by way of a movable coupling, and the attachment mechanism is movable about an axis of the movable coupling from an original position outside of the channel to a position within the channel.

7. The system of claim 6, wherein the attachment mechanism moves about the axis, in response to the second downward force, as the door is pulled downward until a back of the attachment mechanism rests against a surface of the door.

8. The system of claim 1, wherein the elevated doorway is an attic doorway for accessing an attic of a building, and wherein the door is an attic door having hinges for hinging the attic door to the elevated doorway such that the door is pulled down by the hand operated reaching device through a path of motion permitted by the hinges in response to the application of the second downward force.

9. The system of claim 1, wherein the loop portion is rigid and fixed at an orientation substantially perpendicular to the plane of the door of the elevated doorway when the pull device is coupled to the door by insertion of the attachment portion into the hole in the door.

10. A method of opening an attic door of an attic doorway, comprising:

attaching a pull device to the attic door by inserting an attachment portion of the pull device into a hole in the attic door, wherein the pull device comprises a loop portion, an attachment portion, and a coupling between the loop portion and the attachment portion, and wherein the loop portion of the pull device descends from a surface of the attic door downward and substantially perpendicular to a first plane of the attic doorway when the attic door of the attic doorway is in a closed position;

engaging the pull device with a hand operated reaching device by inserting a hook of an attachment head of the pull device into a center opening of the loop portion of the pull device, wherein the hand operated reaching device comprises a rigid rod member, a handle coupled to the rigid rod member, and an attachment head coupled to the rigid rod member; and applying a first downward force to the hand operated reach device while the attachment head is engaged with the pull device to impart a second downward force to the pull device causing the attic door to open downward from the first plane of the attic doorway towards a second plane perpendicular to the first plane of the attic doorway, so as to create an opening in the attic doorway for a person to access a next higher level of a building.

11. The method of claim 10, further comprising:

installing a decorative cover piece through which the attachment portion of the pull device is passed before the attachment portion is inserted into the hole in the door.

12. The method of claim 10, further comprising:

fastening the attachment portion of the pull device to the attic door using a fastener.

13. The method of claim 10, wherein:

the attachment head comprises a channel, the hook is coupled to the attachment head by way of a movable coupling, and in response to the applying the first downward force to the hand operated reaching device, the hook is moved about an axis of the movable coupling from an original position to a position within the channel.

14. The method of claim 13, wherein the hook moves about the axis, in response to the first downward force, as the attic door is pulled downward until a back of the hook rests against the surface of the attic door.

15. The method of claim 10, wherein the attic door has hinges for hinging the attic door to the attic doorway such that the attic door is pulled down by the hand operated reaching device through a path of motion permitted by the hinges in response to the applying of the first downward force.

16. The method of claim 10, wherein attaching the pull device to the attic door by inserting the attachment portion of the pull device into the hole in the attic door comprises replacing an existing pull-string of the attic door with the pull device.

17. The method of claim 16, wherein the hole in the attic door is an existing hole through which the existing pull-string of the attic door was attached to the attic door, and wherein replacing the existing pull-string of the attic door with the pull device comprises inserting the attachment portion of the pull device into the existing hole of the attic door.

* * * * *